US009907446B2

(12) United States Patent
Toole et al.

(10) Patent No.: US 9,907,446 B2
(45) Date of Patent: Mar. 6, 2018

(54) FLOOR TOOL FOR A VACUUM CLEANING APPLIANCE

(71) Applicant: Dyson Technology Limited, Wiltshire (GB)

(72) Inventors: Kyle Toole, Malmesbury (GB); David Andrew Isley, Malmesbury (GB)

(73) Assignee: DYSON TECHNOLOGY LIMITED, Malmesbury, Wiltshire (GB)

( * ) Notice: Subject to any disclaimer, the term of this patent is extended or adjusted under 35 U.S.C. 154(b) by 772 days.

(21) Appl. No.: 13/958,144

(22) Filed: Aug. 2, 2013

(65) Prior Publication Data

US 2014/0033471 A1 Feb. 6, 2014

(30) Foreign Application Priority Data

Aug. 3, 2012 (GB) ..... 1213839.2

(51) Int. Cl.

| | |
|---|---|
| ***A47L 9/02*** | (2006.01) |
| ***A47L 9/06*** | (2006.01) |
| ***A47L 9/24*** | (2006.01) |

(52) U.S. Cl.

CPC ..... *A47L 9/0666* (2013.01); *A47L 9/02* (2013.01); *A47L 9/242* (2013.01); *A47L 9/0686* (2013.01)

(58) Field of Classification Search

CPC . A47L 9/02; A47L 9/242; A47L 9/248; A47L 9/0666

USPC ..... 285/7; 403/39; 15/415.1

See application file for complete search history.

(56) References Cited

U.S. PATENT DOCUMENTS

| | | | | |
|---|---|---|---|---|
| 2,516,205 | A * | 7/1950 | Halloek | A47L 9/02 15/373 |
| 4,319,379 | A | 3/1982 | Carrigan et al. | |
| 4,697,949 | A | 10/1987 | Perez | |
| 5,184,372 | A | 2/1993 | MacHe | |
| 5,870,851 | A | 2/1999 | Shoemaker | |
| 6,345,408 | B1 * | 2/2002 | Nagai | A47L 9/02 15/361 |
| 2002/0184726 | A1 | 12/2002 | Kingry et al. | |
| 2004/0134025 | A1 | 7/2004 | Murphy et al. | |

(Continued)

FOREIGN PATENT DOCUMENTS

| | | |
|---|---|---|
| DE | 2 414 826 | 10/1974 |
| DE | 297 04 742 | 11/1997 |

(Continued)

OTHER PUBLICATIONS

International Search and Written Opinion dated May 29, 2015, directed to International Application No. PCT/GB2013/051869; 9 pages.

(Continued)

*Primary Examiner* — Bryan R Muller

(74) *Attorney, Agent, or Firm* — Morrison & Foerster LLP

(57) ABSTRACT

A floor tool for a vacuum cleaning appliance comprising a body including a suction nozzle, a neck coupled to the body so as to pivot relative to it about an axis 'A', wherein the neck includes a base portion that defines a rail formation located at least partially about its circumference and the body includes a runner formation that is engaged with a discrete part of the rail formation, the rail formation being slidable relative to the runner formation thereby coupling the base portion to the body but permitting the base portion to pivot relative to the body.

14 Claims, 15 Drawing Sheets

(56) References Cited

U.S. PATENT DOCUMENTS

| | | | | |
|---|---|---|---|---|
| 2005/0076468 | A1* | 4/2005 | Matousek | A47L 9/02 15/403 |
| 2011/0162157 | A1 | 7/2011 | Dooley et al. | |
| 2012/0110814 | A1 | 5/2012 | Matola et al. | |

FOREIGN PATENT DOCUMENTS

| | | | | |
|---|---|---|---|---|
| DE | 103 24 260 | | 12/2004 | |
| DE | 10324260 | A1 * | 12/2004 | A47L 9/02 |
| DE | 20 2007 014 263 | | 1/2008 | |
| DE | 10 2006 061 196 | | 6/2008 | |
| EP | 0 397 112 | | 11/1990 | |
| EP | 1 600 092 | | 11/2005 | |
| EP | 1 608 253 | | 12/2005 | |
| GB | 2 078 496 | | 1/1982 | |
| GB | 2490804 | | 11/2012 | |
| JP | 58-149143 | | 10/1983 | |
| JP | 3-16547 | | 1/1991 | |
| JP | 9-28638 | | 2/1997 | |
| JP | 11-128141 | | 5/1999 | |
| JP | 2002-85302 | | 3/2002 | |
| JP | 2005-169065 | | 6/2005 | |
| JP | 2005-188647 | | 7/2005 | |
| JP | 2005-198803 | | 7/2005 | |
| JP | 2005198803 | A1 * | 7/2005 | A47L 9/02 |
| JP | 2006-68272 | | 3/2006 | |
| JP | 2007-82723 | | 4/2007 | |
| WO | WO-2004/062454 | | 7/2004 | |
| WO | WO-2004/082449 | | 9/2004 | |
| WO | WO-2004/110655 | | 12/2004 | |
| WO | WO-2008/028748 | | 3/2008 | |
| WO | WO-2008/028749 | | 3/2008 | |
| WO | WO-2008/028762 | | 3/2008 | |
| WO | WO-2008/096950 | | 8/2008 | |
| WO | WO-2008/111891 | | 9/2008 | |

OTHER PUBLICATIONS

Search Report dated Nov. 9, 2012, directed to GB Application No. 1213839.2; 2 pages.

* cited by examiner

FLOOR TOOL FOR A VACUUM CLEANING APPLIANCE

REFERENCE TO RELATED APPLICATIONS

This application claims priority of United Kingdom Application No. 1213839.2, filed Aug. 3, 2012, the entire contents of which are incorporated herein by reference.

FIELD OF THE INVENTION

The present invention relates to a floor tool for a vacuum cleaning appliance, and a vacuum cleaning appliance incorporating such a floor tool, whether as a detachable component or as an integral part.

BACKGROUND OF THE INVENTION

Vacuum cleaners are generally supplied with a range of tools for dealing with different cleaning tasks. For example, such a tool may be a general purpose floor tool for on-the-floor cleaning of both hard and textile surface coverings. Typically, a floor tool comprises a main body which engages with a floor surface. The main body has a lower surface comprising a suction opening through which dirt and dust may be drawn into the floor tool due to a suction force generated by a vacuum cleaner to which the tool is attached. Although floor tools are adept at removing loose dirt and debris from a floor surface, they are less accomplished at removing other forms of dirt, for example stains, which may be left behind from liquid that is spilt on a hard floor covering. Of course, there are implements available for cleaning such stains. One example is shown in US2002/0184726, in which a long handled cleaning implement includes a cleaning head to which a cleaning sheet is removably attached. Such an implement can then be used by a user to scrub or mop a hard floor surface to remove stubborn stains.

It also is known to combine the functionality of a vacuum cleaner floor tool with a cleaning sheet in order to provide the floor tool with the facility to wipe dirt and stains from a floor surface in addition to the usual function of sucking up loose dirt and debris. By way of example, JP9028638 describes a device which combines a mop with a vacuum cleaner floor tool by arranging an elongate nozzle adjacent a mop holder to which a mop is attached. The floor tool therefore carries out floor wiping and vacuum cleaning functions. Also, EP1608253 discloses a floor tool for a vacuum cleaner in which a rectangular supporting element carries a disposable wipe and wherein elongate suction nozzles are positioned adjacent the fore and aft long edges of the support element.

Although such combined mop and suction floor tools have their advantages, the cleaning performance of such tools on hard floors tends to be compromised and their versatility is limited. It is with a view to addressing these drawbacks that the invention has been devised.

SUMMARY OF THE INVENTION

In a first aspect, the invention provides a floor tool that may be integral with or removably connectable to a vacuum cleaning appliance, the floor tool comprising a support member adapted to support a cleaning element and at least one suction nozzle in communication with a conduit that is coupled to a vacuum cleaning appliance, in use, wherein a neck for controlling the floor tool is coupled to the support member and wherein the at least one suction nozzle is configured so as to float relative to the neck.

The invention therefore provides a floor tool in the context of a vacuum cleaning appliance that has a dual functionality. Firstly, the floor tool provides a suction cleaning function and, secondly, the floor tool has the capability to carry a cleaning element, preferably in the form of a wiping sheet, to wipe the floor surface at the same time as vacuuming the floor surface. The suction nozzle is configured to float relative to the connecting neck of the floor tool which confers several benefits. Firstly, the downwards force applied to the user via the neck is transmitted directly to the support member, but not to the suction nozzle, the downwards pressure improving the cleaning performance of the wipe sheet carried on the support member. Secondly, since very little downwards force is applied to the suction nozzle, it is able to ride lightly across the floor surface which benefits the pickup performance of the suction nozzle.

Although the floor tool of the invention may include a single suction nozzle located adjacent a leading or trailing edge of the support member, an alternative embodiment includes first and second suction nozzles, one nozzle located adjacent a respective one of the leading and trailing edges of the support member.

In the preferred embodiment, the suction nozzles communicate with a manifold that may be located in a central position with respect to the support member, each of the suction nozzles being linked to the manifold by a fluid carrying arm. The fluid carrying arms and the nozzles are therefore configured into an 'overslung' arrangement over the support member.

The manifold may extend through a part of the neck of the floor tool and may be dimensioned so that the manifold is permitted to move relative to the neck in order to provide the suction nozzles with the ability to 'float'. To allow a user to manoeuvre the floor tool the neck may define a first portion that is pivotably attached to the support member about a first axis. The first portion may be cylindrical in form that defines a rail arrangement arranged at least partially about its periphery and which is engaged with a complementary runner formation on the support member so that the rail arrangement can ride/slide along the runners. Since only the peripheral edge of the cylindrical base portion engages with the support member, the central volume of the cylindrical base portion is substantially free of obstructions so that the manifold can pass through it, thereby coupling the manifold to the support member.

In order to provide a further degree of manoeuvrability, the neck may include a second portion that is pivotably connected to the base portion about a second axis that is perpendicular to the first axis. This allows the floor tool to be swiveled in a plane parallel to the floor surface by rotating the neck, effectively providing the floor tool with the ability to be 'steered'.

In the illustrated embodiment, the manifold communicates with a flexible hose that extends through the second portion of the neck to a connecting part and so serves to duct air from the manifold to an associated vacuum cleaner via the neck.

In a second aspect, the invention provides a floor tool for a vacuum cleaning appliance comprising a body including a suction nozzle, a neck coupled to the body so as to pivot relative to it about an axis 'A', wherein the neck includes a base portion that defines a rail formation located at least partially about its circumference and the body includes a runner formation that is engaged with a discrete part of the rail formation, the rail formation being slidable relative to the runner formation thereby coupling the base portion to the body but permitting the base portion to pivot relative to the body. More particularly, the rail formation may include a rim of the base portion and the runner formation on the body may include a projection that overlaps the rim and is slidable relative to it. In this way, the body holds the base portion of the neck at a discrete point on its rim which means that the centre of the base portion can be left open. The open central area of the base portion is therefore able to receive a conduit of the floor tool. By selection of the dimension of the conduit relative to the base portion, the conduit can be configured to flat relative to the base portion.

The pivoting movement of the neck may be limited by a flange extending inwardly from the rim about a limited portion thereof, the end points of the flange defining limit stops for pivoting movement of the base portion.

The floor tool described above provides a dual function tool which works to suck debris from the floor and also to clean the floor with a wet or dry cleaning wipe. However, it is possible that a user may wish to vacuum the floor without needing to wipe the floor as well. Therefore, in a third aspect, the invention provides a floor tool for a vacuum cleaning appliance comprising a support member adapted to support a cleaning element and at least one suction nozzle in communication with a conduit, wherein the support member comprises a removable pad which is detachable from the support member and a rolling arrangement depending from the support member.

The invention enhances the versatility of the floor tool since the tool can be used in a "suction-and-wipe" mode of operation in which the suction nozzles combine in function with the removable pad, and a 'suction-only' mode of operation in which only the suction nozzles are involved with cleaning the floor surface. Such an arrangement may, in practice, be used frequently by a user as a hard floor cleaner since it is envisaged that a floor surface will require vacuuming more often than it requires wiping with a moist disposable wiping sheet. The floor tool is therefore not limited to using the floor pad in conjunction with the vacuuming facility.

The support member may include a carrier plate from which the removable pad is separable, the rolling arrangement being provided on the underside of the carrier plate.

Although the rolling arrangement could be embodied by rollers, spheres, casters, or even low-friction skids, one option is the rolling arrangement includes a plurality of wheels or rollers that depend down from the support member to define a plane of contact parallel to the floor surface.

The wheels or rollers may extend at least partially into apertures defined in the removable pad when the removable pad is coupled to the carrier plate.

In the floor tool as described above, there is a risk that the rather convoluted geometry of the suction nozzles and the fluid flow conduit can cause debris to be trapped within the fluid flow path of the tool. There is a need to mitigate this risk and thus, in a fourth aspect, the invention provides a floor tool for a vacuum cleaning appliance comprising a support member adapted to support a cleaning element and at least one suction nozzle in communication with a conduit, wherein the conduit includes one or more plug elements that are engageable with respective sockets provided in the conduits, the plugs being removable from the sockets to provide access to the interior of the conduit. The invention therefore provides a floor tool that combines suction and wipe-cleaning capability with improved user maintainability.

The plug elements may be secured to their respective sockets by way of a press- or screw-fit so that they are mounted securely. Optionally, the plug elements may include a tether which serves to retain the plug elements in a position close to the sockets when they are removed so as to reduce the likelihood of the plug elements being mislaid. Alternatively, the plug elements may be hinged relative to the conduit so that the elements can be hinged away from the sockets but still being attached to the conduit.

In the preferred embodiment, the manifold is configured in a central position on the support member and first and second suction nozzles are located against leading and trailing edges of the support member in the direction of movement. In this embodiment, the plug element, or elements, may be provided on the manifold which provides a central access point to the conduit increasing the ease at which blockages can be cleared. In one embodiment, first and second plug elements are provided at opposite ends of the manifold, which is substantially tubular. Therefore, access is provided at each end of the manifold and which also allows a cleaning implement to be pushed right through the manifold.

One advantage of the floor tool of the invention is that the ability of the floor tool to pick up dust, fluff and other debris from a floor surface is improved. Part of this benefit is achieved by arranging first and second suction chambers on either side of a wipe support member, but the performance improvement is also achieved by way of a configuration of the suction nozzles themselves. Therefore, from a fifth aspect, the invention provides a floor tool for a vacuum cleaning appliance, the floor tool comprising a main body including a suction nozzle comprising a surface engaging skirt that depends downwardly to define an outer periphery of a suction chamber having a suction chamber outlet, the surface engaging skirt including a leading edge, a trailing edge, and side edges extending between the leading edge and the trailing edge, and wherein the trailing edge depends downwardly from the suction nozzle by a first distance and the leading edge depends downwardly from the suction nozzle by a second distance that is less than the first distance so as to define a predetermined gap with a floor surface, in use.

In effect, therefore, the suction nozzle configuration provides a narrow gap substantially across the full width of the nozzle, although a full width gap is not essential, which gap enables a great amount of debris to be drawn into the suction nozzle and, therefore, to the associated vacuum cleaner. The skirt member may, in theory, be formed from any material that provides a strip-like member for engaging the floor surface and to form a seal with it so that airflow may get in to the suction nozzle primarily through the leading edge gap. For example, a wall of bristles may provide a suitable strip. However, it is preferred that the surface engaging skirt is flexible, so that is has the ability to confirm to a floor surface, and preferably a strip of plastics material, such as rubber.

Although the skirt may be formed from several pieces, each forming a substantially unbroken skirt, it may also be formed from a single strip of material. Preferably the strip of material is overmoulded onto the main body of the suction nozzle as this avoids more complicated techniques that would be required to attach a flexible strip or strips to the underside of the suction nozzle.

The precise dimensions of the gap are to some extent determined by the suction power of the vacuum cleaning device with which the floor tool is used. However, it is currently envisaged that a gap width of between 1 mm and 4 mm provides a suitable high speed air flow through the gap while admitting a wide range of debris to enter the floor tool through the gap. Most preferred is a gap width of about 3 mm, that is to say that the leading edge depends downwardly from the suction nozzle by a distance that is between 3 mm less than the distance of the trailing edge so as to define a gap of 3 mm with the floor surface.

In one embodiment, a longitudinal wall extends along the suction chamber longitudinally to partition the suction chamber into front and rear suction channels. One or more openings may be provided in the longitudinal wall, or at the ends thereof, to allow fluid to flow through the openings between the front suction channel and the rear suction channel.

The skirt may also include a lateral wall that extends between the trailing edge and the leading edge, or between the trailing edge and the longitudinal wall, so as to partition the suction chamber into first and second sub-chambers each having an associated suction chamber outlet. The lateral wall may depend downward by the same amount as the trailing edge of the skirt or, alternatively by an amount the same as the leading edge of the skirt.

As mentioned above, the configuration of the suction nozzle increases the ability of the floor tool to pick up small debris in particularly and, importantly, dirt and debris that resides in crevices in the floor surface such as floorboard gaps etc. However, the fourth aspect of the invention has particular utility in the context of the dual function floor too which combines a suction function and also a hard floor wiping function. In this manner, the main body may include a support member adapted to support a cleaning sheet and wherein the suction nozzle lies adjacent a first edge of the supporting member.

Although such a floor tool may be adequate with a single suction nozzle, it is preferred that a further suction nozzle is provided that lies adjacent a second edge of the support member parallel to the first edge.

When two suction nozzles are provided the openings in the longitudinal wall in the first suction nozzle may be configured with a flow area that is different to the flow area of the openings in the longitudinal wall of the second suction nozzle. The effect of this is to bias the 'suction power' generated by the vacuum cleaner either more to the front or more to the rear suction nozzle.

As has been mentioned, the floor tool of the invention combines the functionality of a suction-type tool and a hard floor wipe implement. It is known to attach a wipe to a base plate by hook and loop fastening systems and also to wrap the wipe sheet around a base plate so that edges of the wipe sheet can be pushes into slit formations defined on the top of the wipe sheet. However, such attachment schemes can fail to hold the wipe sheet securely and the wipe sheet can tend to pull away from the attachment scheme during the back and forth movement of the floor tool. With a view to improving the means by which a wipe sheet is attachable to a suction-type floor tool, the invention therefore provides, in a sixth aspect, a floor tool for a vacuum cleaning appliance comprising a support member adapted to support a cleaning sheet and at least one suction nozzle adjacent the support member, wherein the support member includes a carrier plate and a floor engaging pad that are releasably held together by a clamping arrangement so that edges of a cleaning sheet can be clamped between the carrier plate and the floor pad in order to hold the cleaning sheet securely on the pad.

Such a configuration provides a particularly usable scheme for a user to attach a cleaning sheet to the floor tool, and one which fastens securely the cleaning sheet so that it cannot work itself loose during use. In one embodiment, once the cleaning sheet is wrapped around the floor pad, the clamping means is operable to automatically lock the floor pad to the carrier plate when the floor pad is pushed against the carrier plate. In this way a user simply has to push the carrier plate onto the pad and the two parts are locked together, which can be done form a standing position. This is particularly convenient from a user's perspective.

The clamping means may include at least one button which is operable by a user to release the floor pad from the carrier plate. The button may be mounted to an upper surface of the floor pad about a pivot point and defines a latch face for cooperating with a catch face provided on the carrier plate. The automated latching of the button arrangement may be embodied by a catch face including an upper surface and an inclined lower surface which strikes a surface of the button as the floor pad is brought into contact with the plate, the inclined lower surface thereby urging the button to pivot clear of the catch to allow the floor pad to fully engage with the carrier plate, whereby the button return-pivots into a position to lock the floor pad to the carrier plate.

Although only a single button could be provided, which would cause one side of the pad to be releasable, in the preferred embodiment first and second user operable buttons are disposed at each end of an upper surface of the floor pad to engage with respective catches on the carrier plate.

Sufficient force to capture the cleaning sheet securely between the carrier plate and the floor pad may be provided by sandwiching the cleaning sheet between the two components. However, to increase the hold that the floor tool has on the sheet, the carrier plate/floor pad may further comprise a gripping arrangement configured to grip edges of a cleaning sheet in circumstance when a cleaning sheet is engaged between the floor pad and the carrier plate. The gripping arrangement may be defined by at least one rib provided on the floor pad, the rib being engageable with a respective channel provided on the carrier plate.

It should be appreciated that preferred and/or optional features of first, second, third fourth, fifth and sixth aspects of the invention may be combined with each other as appropriate.

BRIEF DESCRIPTION OF THE DRAWINGS

Embodiments of the invention will now be described, by way of example only, with reference to the accompanying drawings, in which.

DETAILED DESCRIPTION OF THE INVENTION

Figure 1:
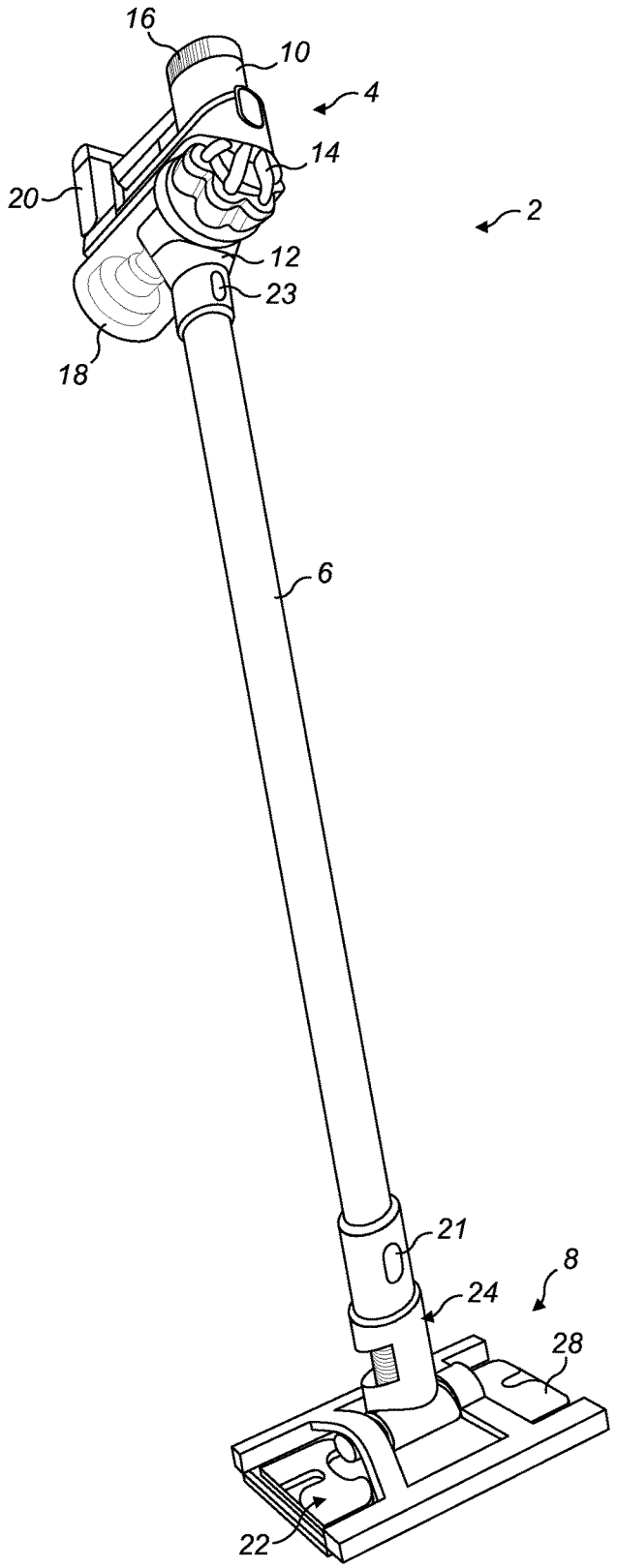
FIG. 1 is a perspective view of a vacuum cleaning appliance and associated floor tool in accordance with the invention.

With reference firstly to FIG. 1, a vacuum cleaning appliance 2 of the so-called 'stick-vac cleaner' type comprises a handheld vacuum cleaner 4 which can be carried in the hand of a user.

An elongate wand 6 is attached to the handheld vacuum cleaner 4 which reaches down to a floor tool 8 provided at the end of the wand 6, the floor tool 8 resting on a floor surface in normal use. Note that the floor surface itself is not shown explicitly in FIG. 1, but its presence is implicit.

The handheld vacuum cleaner 4 comprises a motor-driven fan unit (not shown) which is arranged inside a motor casing 10 and draws air in through an air inlet nozzle 12 positioned at the front of the handheld vacuum cleaner 4. The elongate wand 6 is connected to the air inlet nozzle 12, and the floor tool 8 is in turn connected to the lower end of the wand 6. In use, dirty air is drawn in through the floor tool 8 and is ducted to the air inlet nozzle 12 through the wand 6. Dirty air that enters the air inlet nozzle 12 passes through a cyclonic separation system 14 that separates dirt from the air, and then relatively clean air is then exhausted back to the ambient environment via an exhaust 16 located at the rear. The dirt which is separated from the airflow inside the cyclonic separating system 14 is collected in a bin 18 for disposal. The hand held vacuum cleaner 4 is powered by a multi-cell rechargeable battery which is housed in a battery pack 20.

The floor tool 8 is detachable from the wand 6 by means of a catch 21. The wand 6 is in turn detachable from the handheld vacuum cleaner 4 by means of a further catch 23. The handheld vacuum cleaner 4 can thus be used in isolation as a standalone unit by detaching the wand 6 or, alternatively, the handheld vacuum cleaner 4, wand 6 and floor tool 8 can be used in combination as a hard floor cleaning device with a suction functionality.

It should be noted that the vacuum cleaner 2 in FIG. 1 illustrates one potential configuration in which the floor tool 8 of the invention may be used. In the context of a stick-vac cleaner, the floor tool 8 provides a convenient and portable way in which to clean hard floors in particular. However, the floor tool 4 may also be used with other types of vacuum cleaners, for example connected to a wand and hose assembly of a cylinder or upright vacuum cleaner. Although it is preferred that the floor tool is connectable to an associated vacuum cleaner, this is not essential to the invention and the floor tool may be an integral component, for example integral to the wand in the handheld vacuum cleaner of FIG. 1.

Figure 3:
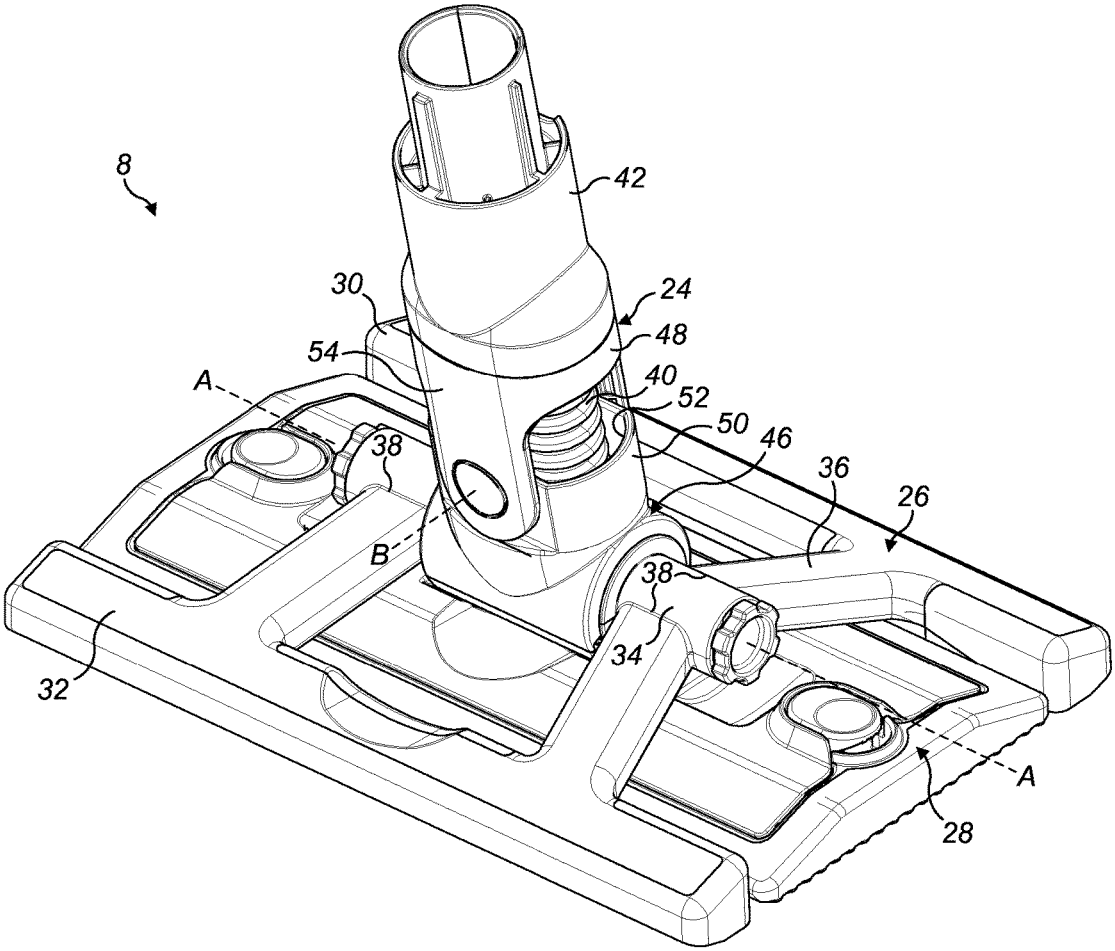
FIG. 3 is a perspective view from the rear of the floor tool in FIG. 2.
Figure 4:
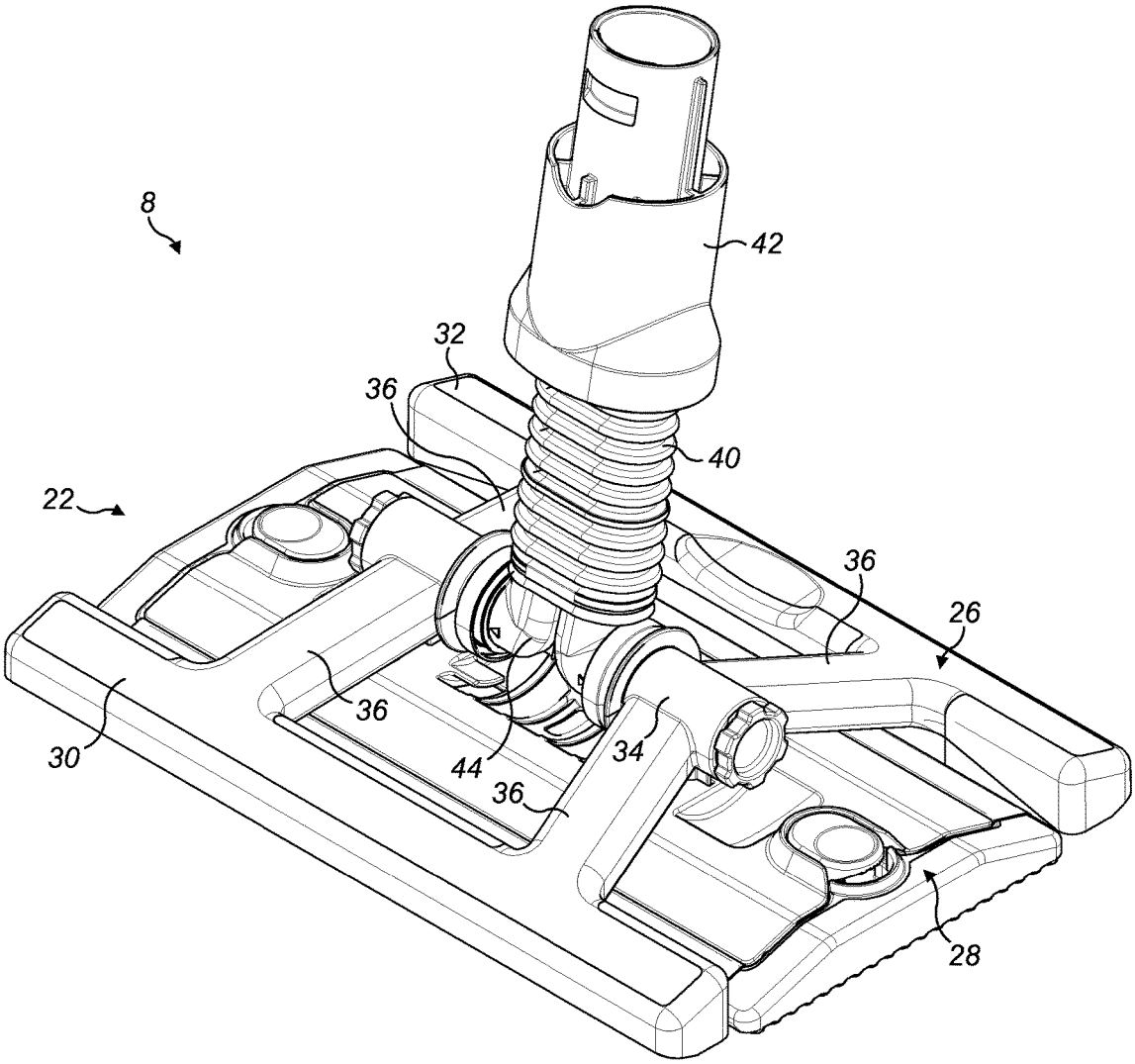
FIG. 4 is a view like that in FIG. 2, but with a neck of the floor tool partly removed to show an internal flow passage.

Turning also to FIGS. 3 and 4 which show the floor tool 8 in more detail, the floor tool 8 comprises a main body 22 and a pivotable neck 24 which serves to connect the floor tool 8 to a vacuum cleaner and enables a user to manoeuvre the floor tool across a surface to be cleaned.

The main body 22 comprises a suction nozzle assembly 26 and a generally oblong support member 28 on which can be carried a sheet-like cleaning element (not shown). The suction nozzle assembly 26 includes first and second elongate suction nozzles 30, 32 arranged adjacent respective long edges of the support member 28.

Figure 2:
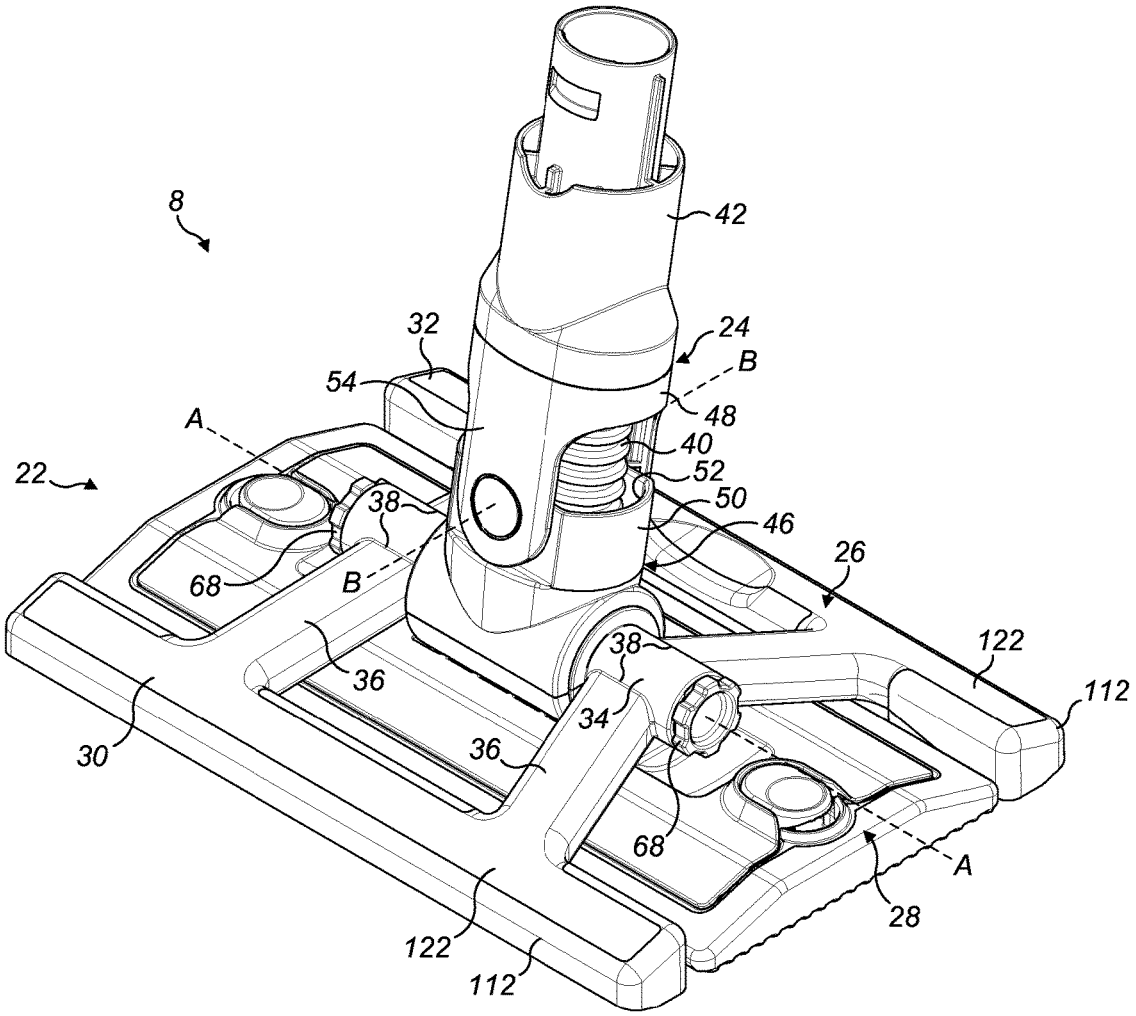
FIG. 2 is a perspective view from the front of the floor tool in FIG. 1 isolated from the vacuum cleaner body.

In FIG. 2, the floor tool 8 is oriented such that its 'front' is facing towards the left hand side of the drawing. Therefore, the first and second suction nozzles 30, 32 can be considered to be a front suction nozzle 30 and a rear suction nozzle 32, respectively, and shall be referred to as such from now on.

The suction nozzle assembly 26 includes a central air manifold 34 that is mounted to an upper surface of the support member 28. Each of the first and second suction nozzles 30, 32 are supported relative to the manifold 34 by first and second connecting arms 36 that extend away in opposite directions at either end of the manifold 34. Each of the connecting arms 36 is hollow and therefore serves as a fluid passageway along which air is ducted from the nozzles 30, 32 to the manifold 34.

The manifold 34 is coupled to the neck 24 so that the neck 24 pivots about a central part of the manifold 34 located between the junctions 38 where the connecting arms 36 meet the manifold 34. However, as will become clear, although the neck may pivot around the manifold, the manifold is able to float up and down with respect to the neck. As marked on FIG. 2, the neck 24 pivots about axis A.

The neck 24 has an open structure which houses a flexible hose 40 extending from the manifold 34 to an upper connecting part 42 of the neck 24. The neck 24 therefore serves to duct air from the suction nozzles 30, 32 to an associated vacuum cleaner via the connecting part 42. As shown clearly in FIG. 4, in which a part of the neck 24 has been removed for clarity, the flexible hose 40 extends from the connecting part 42 of the neck to a T-shaped junction pipe 44 that connects to both sides of the manifold 34 and therefore functions to converge air flowing through the manifold 34 into the flexible hose 40. The T-shaped pipe 44 is connected to the manifold 34 so as to be angularly movable about the axis A.

Figure 5A:
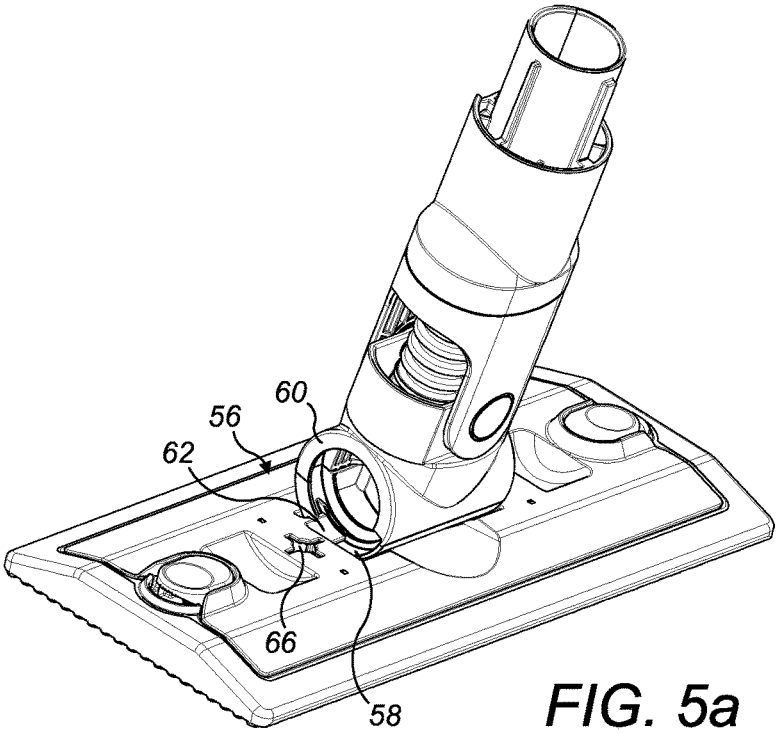
FIGS. 5*a* and 5*b* are perspective views of the floor tool in FIGS. 2 and 3 but with its suction nozzle assembly removed in order to show the way in which the neck connects to a support member of the floor tool.
Figure 5B:
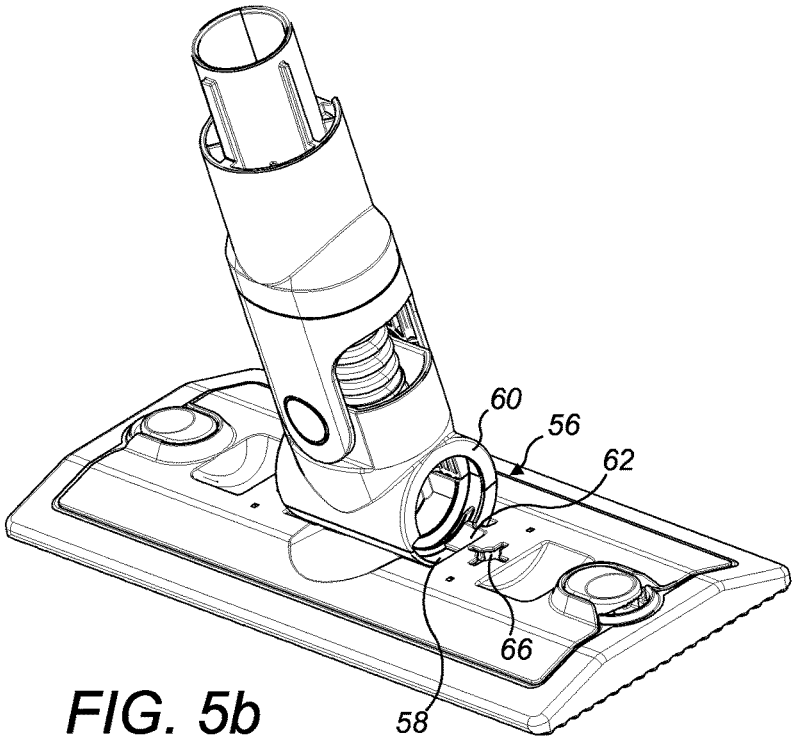

In FIGS. 5*a* and 5*b*, the suction nozzle assembly 26 has been removed so as to illustrate clearly the manner in which the neck 24 is pivotably connected to the support member 28. Broadly, the neck 24 comprises first and second neck sections 46, 48 that cooperate with each other to define a universal joint. In this way, the first (lower) neck section 46 allows the neck to swing up and down relative the main body 22 about the axis A, and the second (upper) neck section 48 allows the connecting part 42 to pivot relative to the first section 46 about an axis B that is perpendicular to the axis A. This enables the floor tool 8 to be manoeuvred easily by a user such that a rotating movement of the wand results in the floor tool rotating in a plane parallel to the floor over a wide range of angles between the neck and the floor tool.

With this in mind, the first neck section 46 is generally cylindrical in form and engages with the support member 28 so that it can rotate about axis A. The first neck section 46 also includes a rectilinear or box-like extension 50 that extends away perpendicularly and defines an opening 52 through which the flexible hose 40 extends up through the interior of the neck 24. The second neck section 48 includes two parallel forks 54 that are journaled to the box-like extension 50 so as to be able to swing left and right about the axis B, being perpendicular to axis A.

The first neck section 46, more specifically the cylindrical portion of it, is engaged with the support member 28 by way of a rail formation 56. Each outer end or 'rim' of the first neck section 46 includes a rail portion 58 around part of its circumference in between an inwardly projecting flange 60 that extends about the remainder of the circumference. The rail portion 58 is retained under a projection 62 in the form of a tab or tooth defined by the support member 28. The projection 62 engages a discrete part of the rail portion 58 and runs along the rail portion 58 as the neck 24 is inclined up and down with respect to the support member 28. The projections 62 therefore act as a 'runner formation' that engage and cooperate with the rail portions 58 to allow the neck 24 to pivot. The term 'discrete part' is used to mean that the projection 62 engages only a sub-section of the rail portion 58, and this arrangement permits the neck section 46 to remain substantially open so that the manifold can pass through it.

Figure 6A:
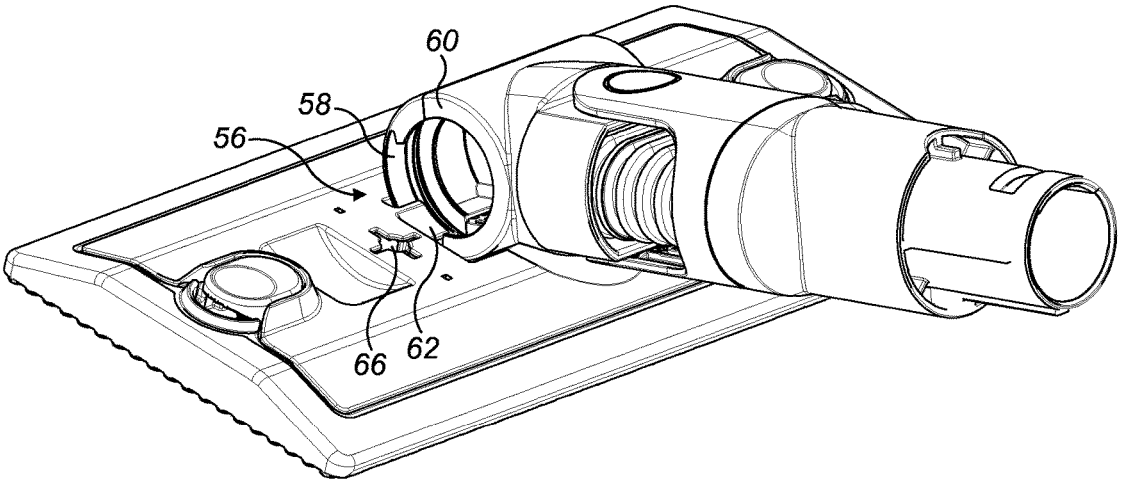
FIGS. 6*a* and 6*b* are views like those in FIGS. 5*a* and 5*b* but the neck is in a reclined position.
Figure 6B:
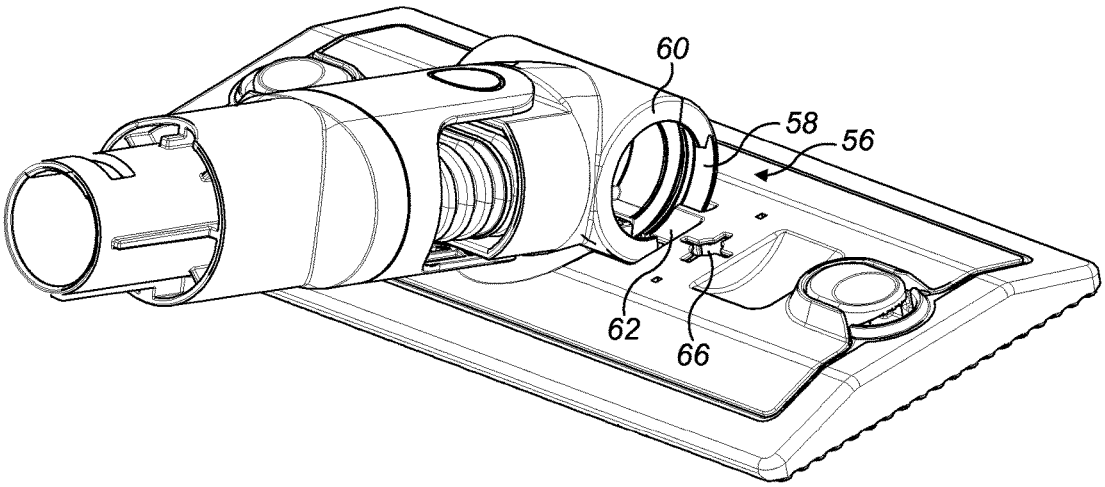

It should be noted that FIGS. 5*a* and 5*b* show the neck in an inclined position, this position being limited by the engagement of the projections/runners 62 against an extreme end of the flange 60, whereas FIGS. 6*a* and 6*b* show the neck in a reclined position, the position being limited by the runners 62 engaging the other extreme end of the flange 60.

The rail arrangement 56 between the neck 24 and the support member 28 provides a direct connection between these two components so that the neck can apply a downward force to the support member 28 during cleaning. However, the coupling also envelops and retains the manifold 34 so that it is permitted to move up and down or 'float' with respect to the support member 28 and also, therefore, the neck 24. In this respect, the diameter of the first neck section 46 is larger than the diameter of the manifold 34 so that the manifold 34 can move relative to it. This is particularly advantageous, as it allows downwards force to be exerted on the support member 28 through the neck, which promotes the wiping action of the support member 28, whilst enabling the suction nozzles associated with the manifold 34 to ride lightly over the floor surface without being pressed down too forcefully. Since the suction nozzles are in light physical contact with the floor surface, the ability of the floor tool to remove dirt from crevices in the floor surface is improved.

In this embodiment, the manifold 34 is permitted approximately 5 mm of vertical linear movement with respect to the support member 28, the amount of movement being determined by the difference in diameter between the manifold 34 and the neck 24, however it should be appreciated that the value of 5 mm is given here as an example only and is not meant to be limitative. Accordingly, the skilled person would appreciate that by selecting the relative dimensions of the manifold and the neck appropriately, different degrees of float are possible. Lateral float may also be permitted in desirable although, in this embodiment, the movement is restricted to vertical movement only.

Figure 7A:
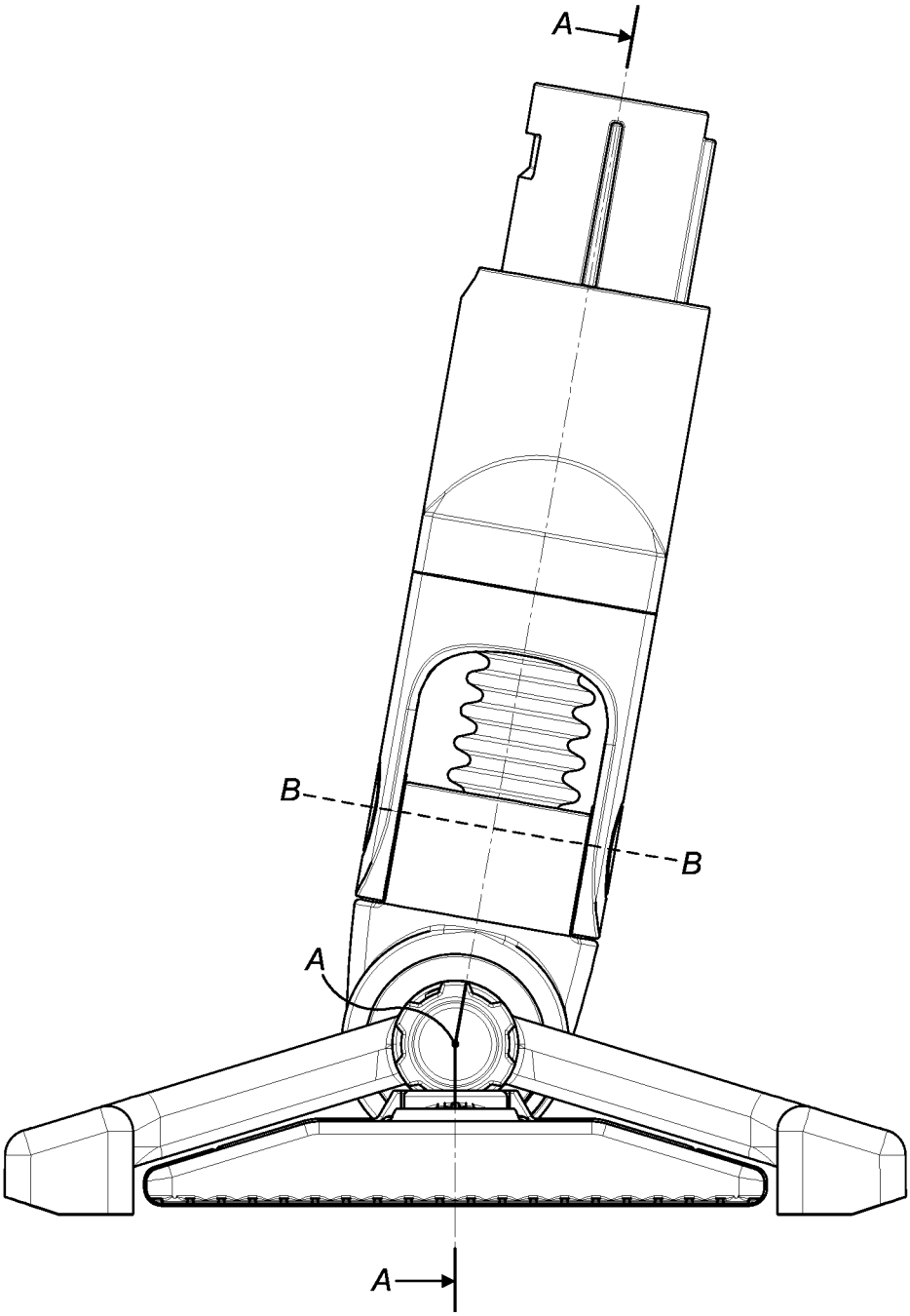
FIG. 7*a* is a side view of the floor tool which shows the support member of the floor tool in a raised position.
Figure 7B:
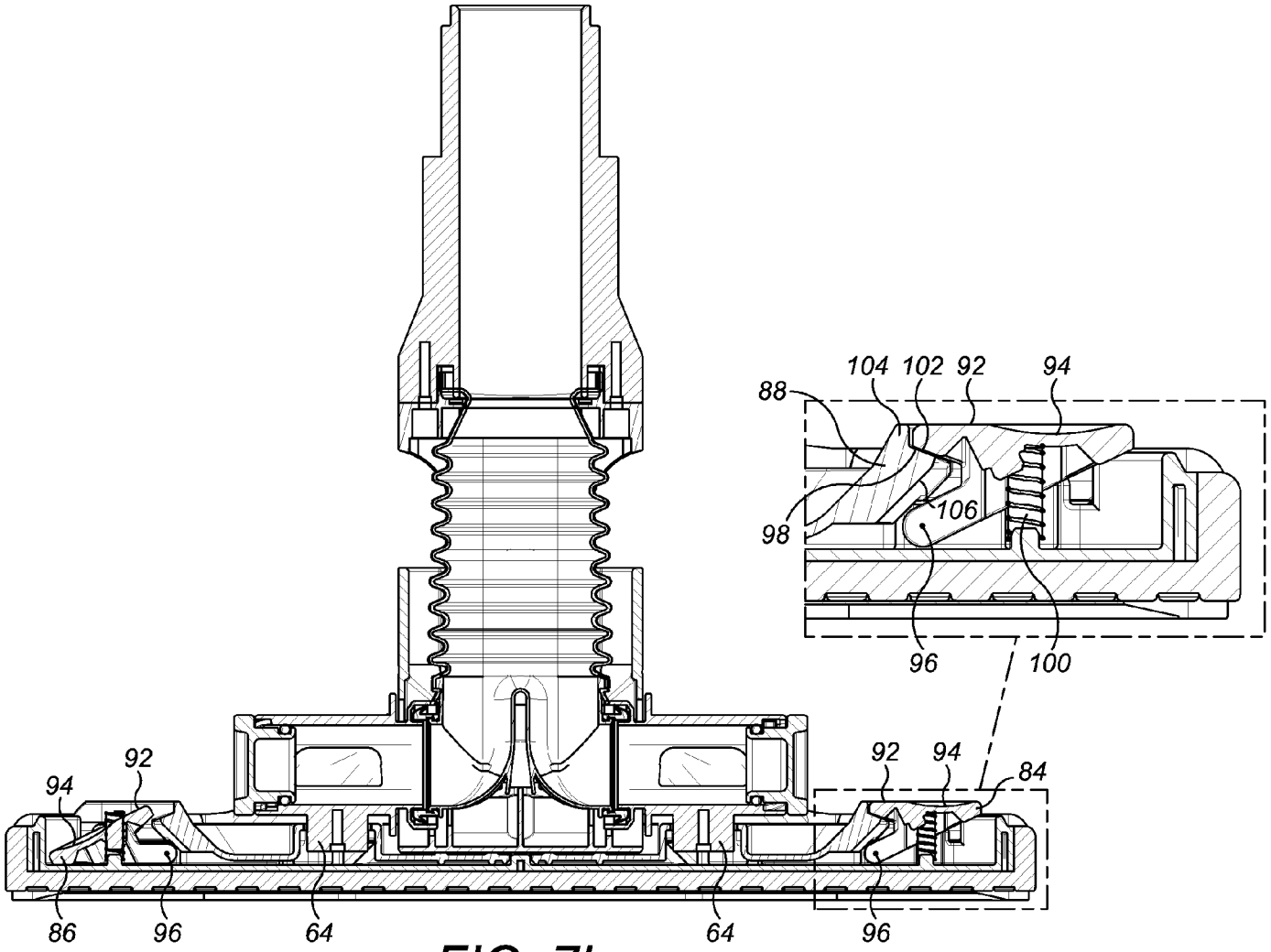
FIG. 7*b* is a section view of FIG. 7*a* along the line A-A.
Figure 8A:
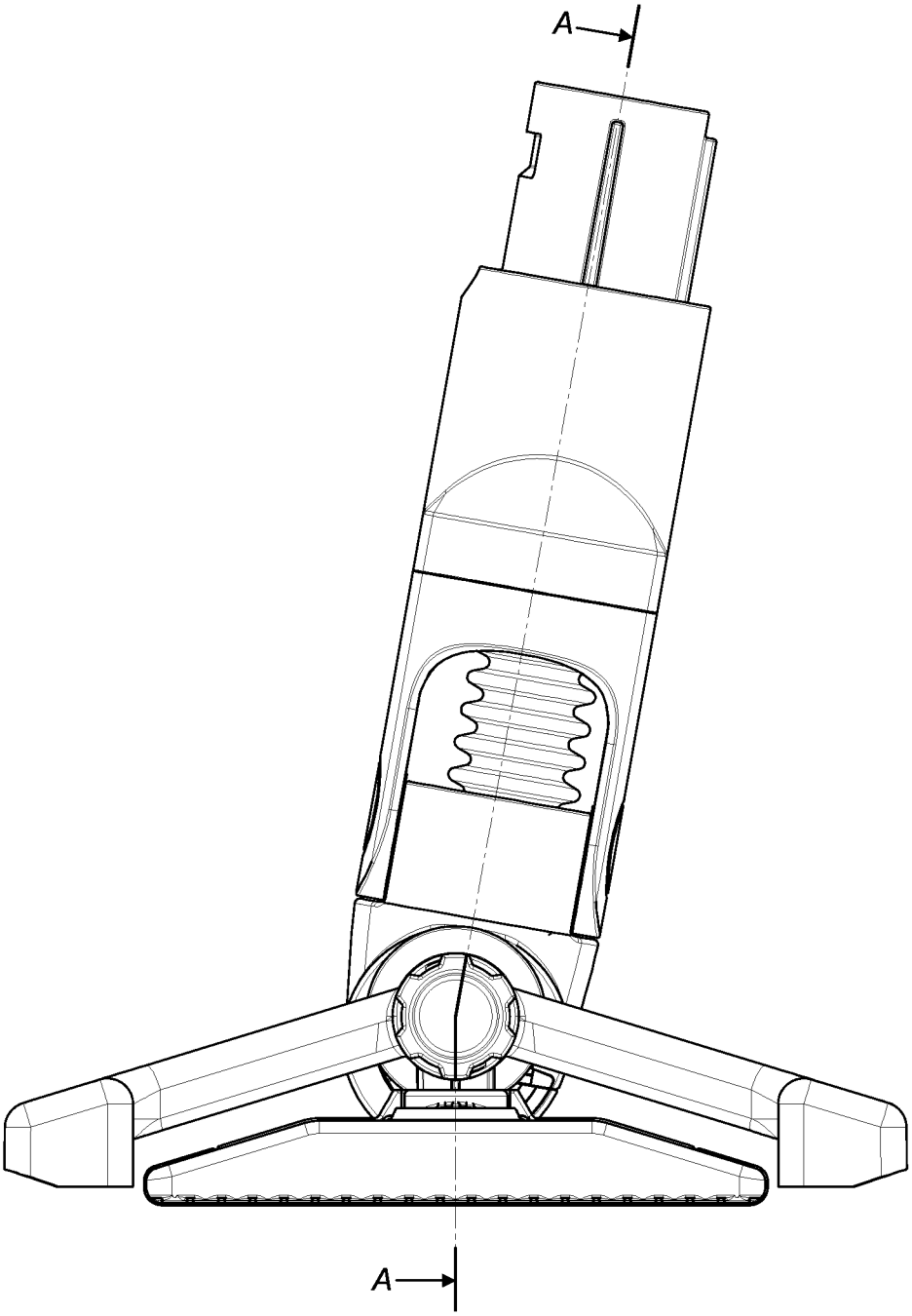
FIG. 8*a* is a view like that in FIG. 7*a* but with the support member in a lowered position.
Figure 8B:
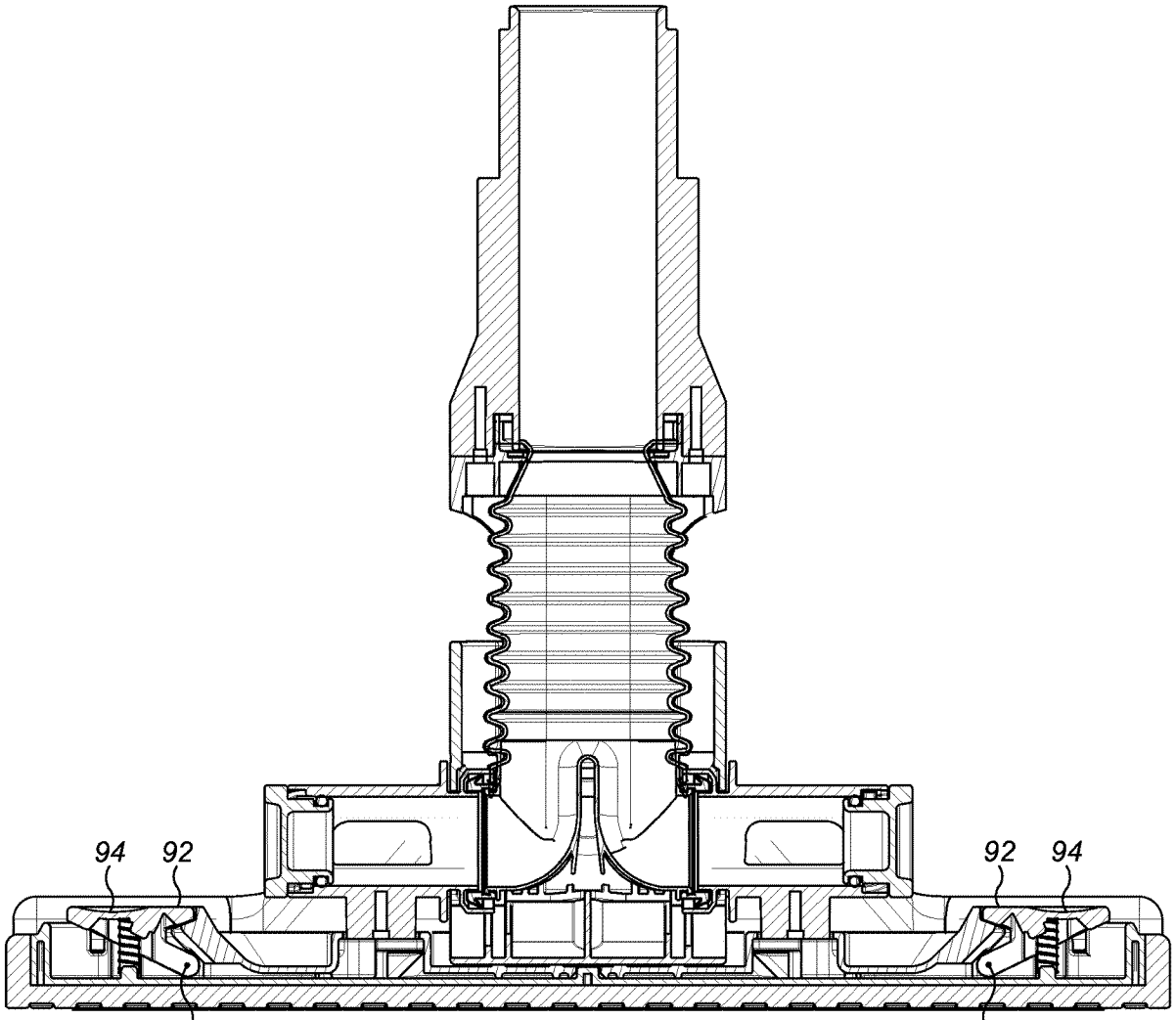
FIG. 8*b* is a section view of FIG. 8*a* along the line A-A.

The effect of the floating suction nozzles 30, 32 is illustrated in the following figures: FIGS. 7*a* and 7*b* show the suction nozzles 30, 32 in a lowered position with respect to the support member 28 and FIGS. 8*a* and 8*b* show the suction nozzles 30, 32 in a raised position with respect to the support member 28. The movement of the manifold 34 relative to the support member 28 is guided by posts 64 formed on the underside of the manifold 34 which slidably engage with complementary shaped guide apertures 34 provided on the upper surface of the support member 28. The suction nozzles and the manifold are therefore able to move up and down in a vertical direction, that is to say, in a direction perpendicular to the floor surface. In use, therefore, the suction nozzles always rest on the floor surface lightly regardless of the thickness of the cleaning sheet that is being used on the tool. So, the support member 28 is able to accommodate cleaning sheets of different thicknesses without changing the ride height of the suction nozzles. So, the pickup performance of the floor tool 8 is retained regardless of the type of wipe element that is affixed to the support member.

Figure 9:
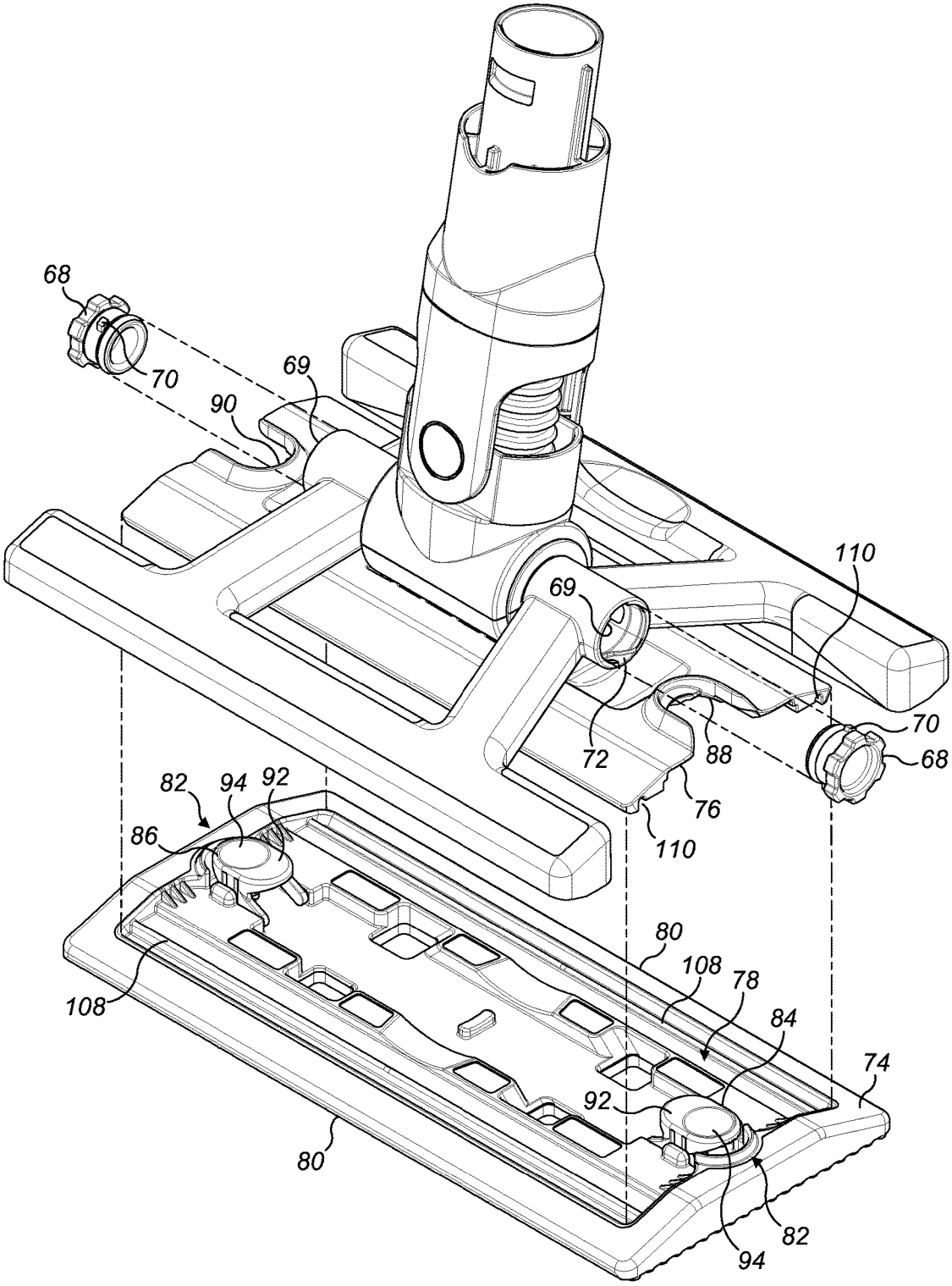
FIG. 9 is a perspective view of the floor tool in an exploded form.

Turning now to FIG. 9, the 'overslung' configuration of the suction nozzle assembly in this embodiment configures the air flow passages with relatively sharp changes of direction and the skilled person will appreciate that there is the potential for debris to become trapped in parts of the suction nozzle assembly. This problem may present itself particularly with long debris, such as hair and fluff, which may catch around the angled pathways of the tool. To provide a solution to this, the manifold 34 is provided with access means comprising first and second caps 68 at opposed extreme ends of the manifold 34. The caps 68 are circular and are engagable in the open ends 69 of the manifold 34 by way of lugs 70 that mate with complementary channels 72 in the open ends 69 of the manifold 34 so as to define a twist-fit engagement. Such a twist-fit engagement is currently preferred since it relies on a positive action by a user to remove the caps. An alternative would be a simple press fit, possibly including a rubber o-ring to ensure a snug fitting, although a risk is that the caps 68 may become dislodged from the manifold 34 inadvertently. As a further alternative, the caps 68 may be coupled to the manifold 34 by a suitable retaining means so that they cannot be completely removed by a user. One way of achieving this would be to mount the caps 68 so that they pivot with respect to the manifold 34 and, in this way, a user could simply pivot the cap away from the manifold in order to gain access to its interior passages. Another alternative would be to retain the caps with some form of tether to allow a limited degree of separation between the manifold 34 and the caps 68.

It is of course possible that a user could remove debris from the manifold 34 if only a single cap were provided in one end of the manifold 34. However, the suction nozzle assembly 26 may more easily be maintained by having a cap at either end of the manifold, since access is provided into each end of the manifold and, by virtue of their location, also into the connecting arms 36. Furthermore, as the manifold 34 is tubular and generally linear, removing both caps 68 allows a visual inspection along the length of the manifold 34, and a cleaning implement such as a brush can be pushed right through it which helps with the removal of debris that may be stuck onto the internal surfaces of the manifold.

As has been mentioned, in a general sense, the floor tool 8 has a dual function: firstly, the support member 28 is adapted to carry a moisture bearing sheet of material, such as a commonly available poly-based disposable wipe, so that the floor tool 8 can be used to scrub stubborn stains and dirt from the floor surface; and secondly, the suction nozzles 30, 32 remove loose dirt and debris from the floor surface for conveyance to the associated vacuum cleaner in a dirt-bearing airflow that is drawn through the floor tool. In order to carry a cleaning element, such as a sheet, as here, the support member 28 comprises a floor pad 74 and a pad carrier plate 76 which are releasably held together so that a wipe sheet can be secured between them when the two parts are engaged, as will now be explained.

FIG. 9 shows the floor pad 74 and the pad carrier plate 76 separated from one another. The floor pad 74 is generally oblong in shape and has an oblong recess 78 defined on its upper side into which the carrier plate 76 is receivable. In use, a cleaning sheet can be wrapped around the floor pad 74 such that ends of the cleaning sheet extend up and over the long edges 80 of the floor pad 74 so as to rest within the recess 78. The floor pad 74 is then engaged with the carrier plate 76 and secured to it which clamps the cleaning sheet in position.

The floor pad 74 is secured to the carrier plate 76 by way of a clamping arrangement 82. The clamping arrangement 82 comprises first and second latches 84, 86 located at respective ends of the floor pad 74. The latches 84, 86 are engageable with respective first and second catches 88, 90 defined by recesses in each short edge of the carrier plate.

Each latch 84, 86 comprises a user-operable button having a generally oval upper face 92 defining a shallow circular recess 94 that acts as a contact point for a finger of a user. The buttons 84, 86 are preferably an engineering plastics such as a polycarbonate/polybutylene terephthalate blend (PC+PBT) which has good strength characteristics and chemical inertness and may be coloured so as to contrast with the surrounding components so that they stand out visually to a user. The high strength and chemical inertness of PC+PBT is preferred, but not essential, for the buttons since they will experience repeated actuation and in use will be subject to cleaning chemicals typically found in domestic cleaning sheets.

The buttons 84, 86 are illustrated clearly in FIG. 7*b*, in which the button 86 on the left hand side of the figure is in a depressed position and the button 84 on the right hand side of the figure is in a rest position. The buttons are identical in this embodiment so reference will be made to a single button for brevity. Each button 84, 86 is pivotable about a pivot point 96 defined on the floor pad 74 and defines a latch face 98 extending towards the centre of the floor pad 74. Biasing means 100 in the form of a spring is provided to bias the button into the rest position. The latch face 98 is engageable with a cooperating catch surface 102 provided on an upstanding ledge 104 defined by the floor pad 74, the latch face 98 of the buttons and the catch surface 102 on the floor pad 74 cooperating to lock the carrier plate 76 to the floor pad 74 when the two components are pressed together firmly.

One benefit of the clamping arrangement 82 is that the buttons 84, 86 lock automatically with the catches 88, 90 which makes it easy for a user to assemble the components. To this end, the catches 88, 90 include a lower surface 106 that is inclined upwardly thereby defining a cam surface. As the floor pad 74 is brought into contact with the carrier plate 76, the cam surface 106 of the catch contacts the upper surface 92 of the button. This contact causes the button 84, 86 to move angularly about its pivot 96. Further movement of the floor pad 74 towards the carrier plate 76 causes the button to be bumped out of the way of the catch face 106 and then for the latch surface 98 to lock into the upper catch face 102, thereby securing the floor pad 74 to the carrier plate 76.

The carrier plate 76 and the floor pad 74 come together to secure a wipe element between them, and it is preferred, although not essential that engagement means are provided between the pad and the carrier plate to strengthen the clamping effect on the wipe element. In this embodiment, the engagement means comprises two elongate ribs 108 provided adjacent the respective long edges of the recess 78 on the floor pad 74 and these project into corresponding channels 110 provided on the underside of the carrier plate 76. The wipe element is therefore effectively clamped into position which reduces the likelihood of the wipe element working loose under the to-and-fro action of the floor tool, in use.

As well as combining the functionality of a hard floor wipe cleaner and a hard floor vacuuming tool, the floor tool 8 of the invention has the facility to be used in a purely vacuuming mode. This may be useful if a user wishes to vacuum the floor surface but does not consider it necessary wipe the floor as well. To this end, the carrier plate 76 includes a rolling arrangement 112 which supports the support member 28 on a floor surface in the absence of the floor pad 74.

Figure 10:
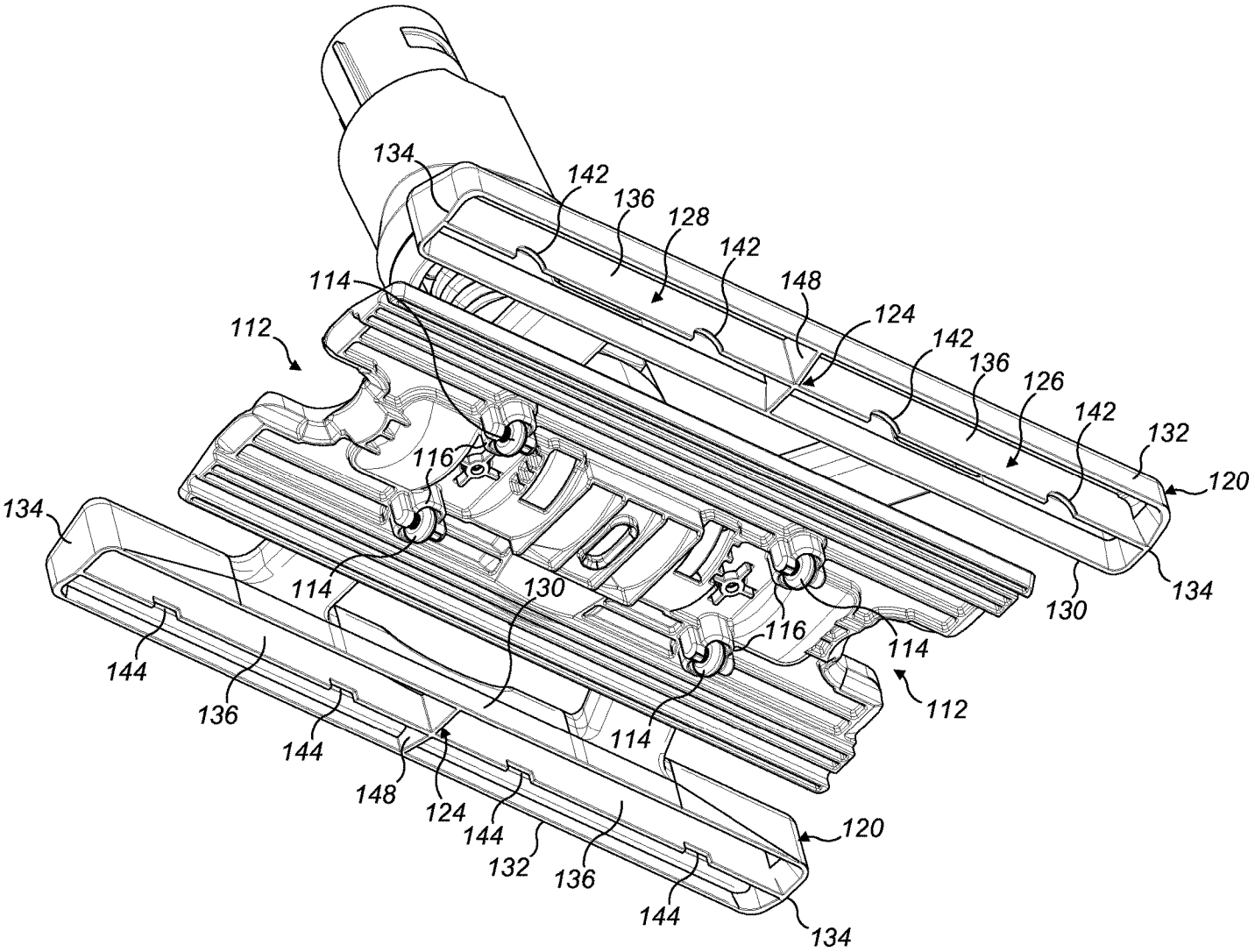
FIG. 10 is a perspective view of the floor tool, from below, with the floor pad removed, in order to show a wheel arrangement of the floor tool.

In this embodiment, as shown clearly in FIG. 10, the rolling arrangement 112 includes two pairs of wheels 114, although these could also be embodied other means for the tool to be guided over a floor surface, for example rollers or casters or even skids. Each wheel 114 is held in a respective wheel cup 116 and has a rolling axis that extends parallel to the long axis of the floor tool 8 (axis A) so that the wheels 114 are oriented in the direction of travel of the floor tool, in use. As shown, the wheels 114 are arranged in pairs, each pair being aligned in a plane perpendicular to the axis A of the floor tool and, in this way, they provide a stable rolling contact point for the carrier plate 76 and bear the force that is applied to the floor tool 8 through the neck 24.

Figure 11:
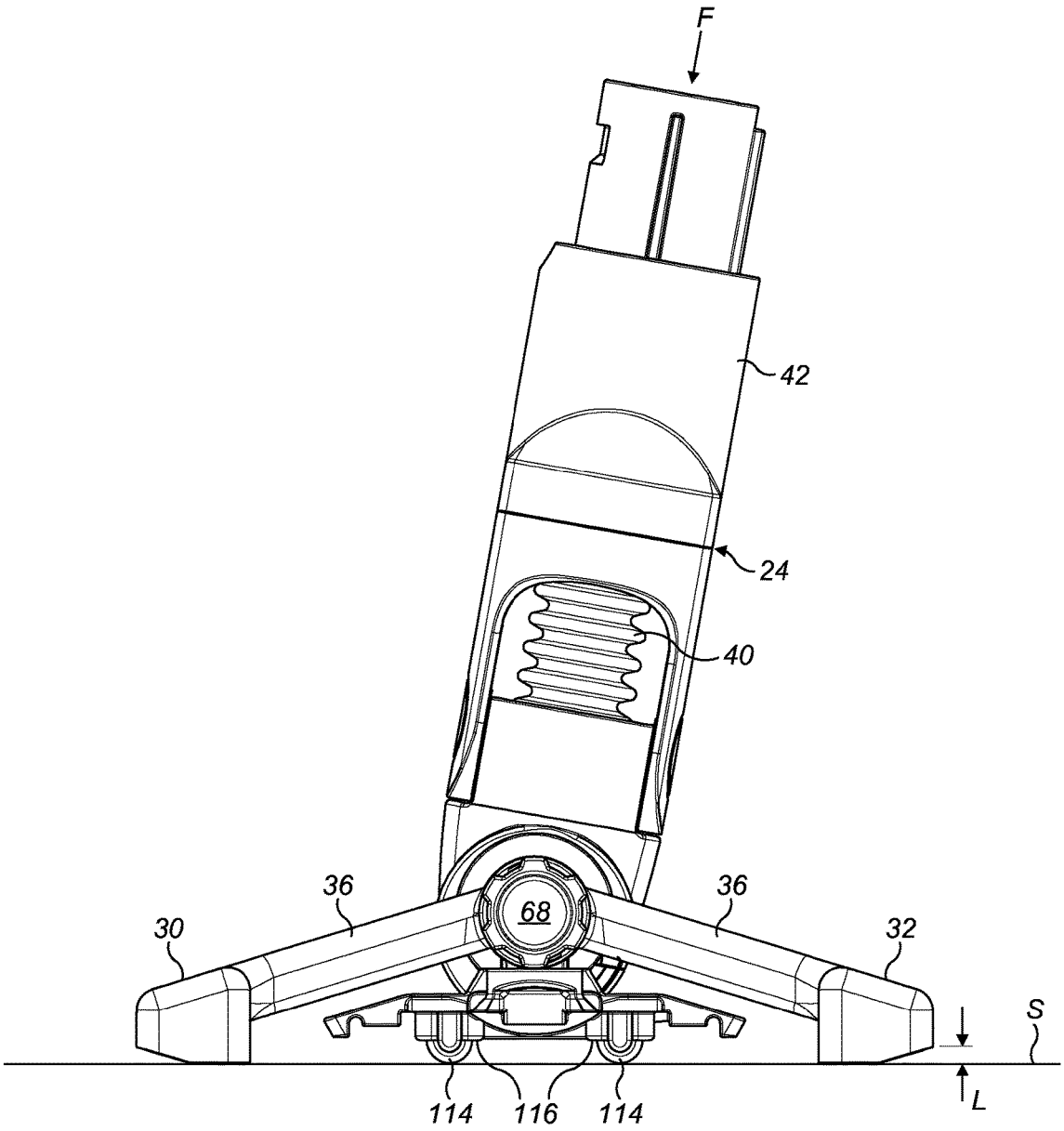
FIG. 11 is a side view of the floor tool in FIG. 10.

This is illustrated particularly well in FIG. 11, in which the carrier plate 76 is in a lowered position with a force F being applied through the neck 24, the wheels 114 bear the carrier plate 76 on the floor surface S, whilst the suction nozzles 30, 32 are free to float relative to the carrier plate 76. It will be appreciated that key to this scheme is that the wheels 114 act as a bearing point for the carrier plate so, in this context, a suitable set of skids and rails would also perform the same function and should therefore be considered to be encompassed by the term 'rolling arrangement'.

Such a tool may, in practice, be used frequently by a user as a hard floor cleaner since it is envisaged that a floor surface will require vacuuming more often than it requires wiping with a moist disposable wiping sheet. The floor tool is therefore not limited to using the floor pad in conjunction with the vacuuming facility which enhances the versatility of the floor tool.

Figure 12:
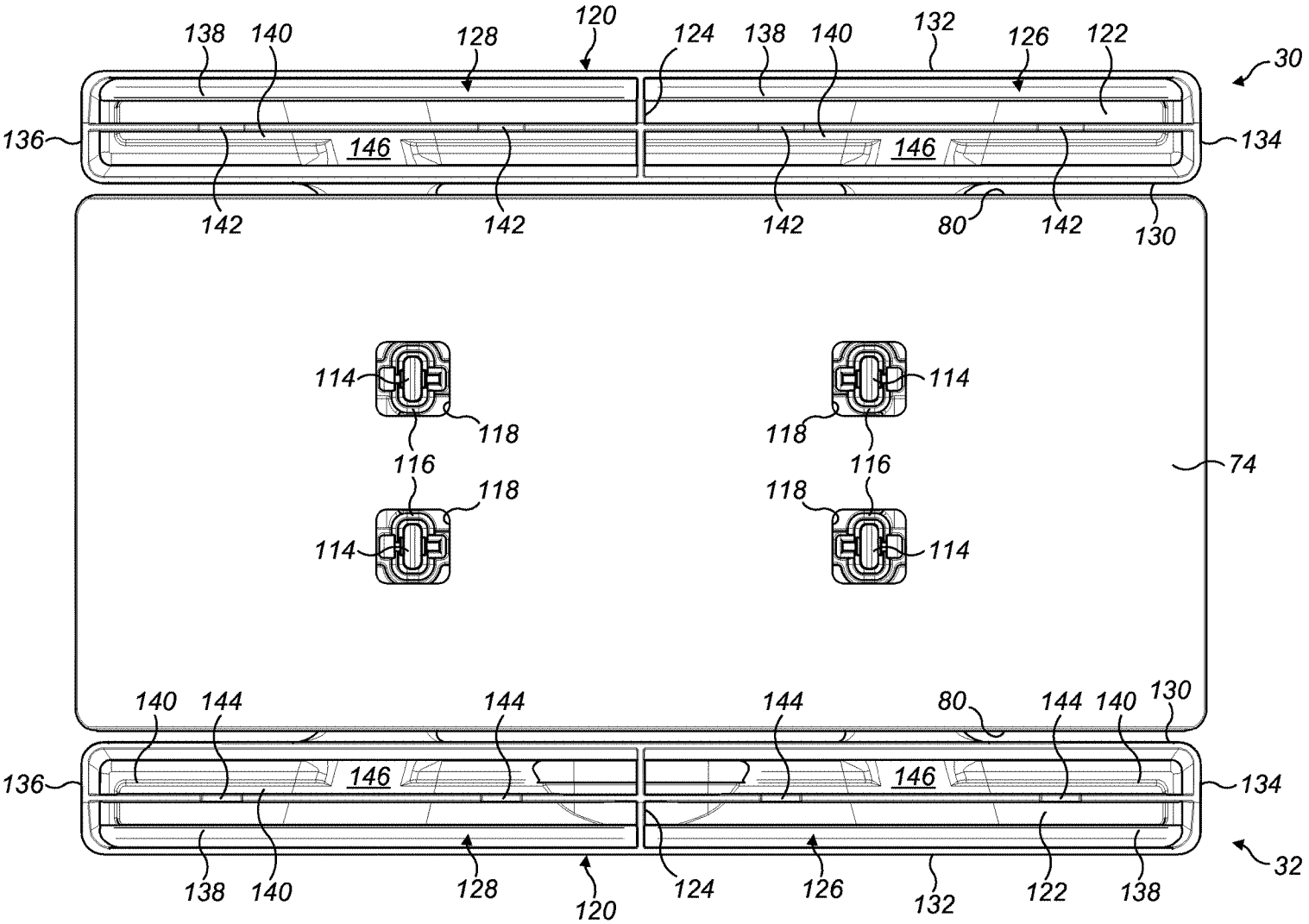
FIG. 12 is a view from underneath of the floor tool in FIGS. 10 and 11.

In circumstances where the floor pad 74 is attached to the carrier plate 76, the wheel cups are received in respective apertures 118 provided in the floor pad 74, as is shown in FIG. 12.

A further advantageous feature of the floor tool 8 of the invention is the configuration of the suction nozzles 30, 32, which provide the floor tool 8 with particularly good debris pickup performance on hard floors, as will now be explained.

With particular reference to FIGS. 10 and 12, each of the front and rear suction nozzles 30, 32 includes a generally rectangular floor engaging skirt 120 that depends downwardly from a rigid upper portion or 'spine' 122 of the suction nozzle. A further member or 'dividing wall' 124 extends transversely between long edges of the skirt 120 approximately mid-way between the two ends of the suction nozzles and therefore divides the suction nozzles into a first suction chamber 126 and a second suction chamber 128, located side by side.

The outer peripheral skirt/wall 120 of the suction chambers 126, 128 and also the dividing wall 124 are, in this embodiment, an integral body made of plastics material, although it is envisaged that the skirt 120 may be made from a plurality of individual strips. In the preferred embodiment, the skirts 120 are a thermoplastic elastomer and are overmoulded onto the spine 122 of the suction nozzles, although it should be appreciated that this is not essential and the skirts could also be inserted into slots defined in the suction nozzle. As a further alternative, the skirts 120 may also be formed from bristles, although currently flexible plastics or rubber strips are preferred for their durability and since they don't tend to capture debris as can occur with bristles.

Each skirt 120 can be considered to include a trailing edge 130 which is located directly adjacent a respective long edge 80 of the floor pad 74, and a leading edge 132 that is remote from the floor pad 74. Furthermore, side edges 134 extend between the leading and trailing edges 132, 130 thereby completing the oblong sealing skirt 120.

In order to promote good debris pickup performance, substantially the entire leading edge 132 of the skirt 120 is shorter than the trailing edge 130 so that it is spaced from the floor surface 'S' when in use. This is shown clearly in FIG. 11 which illustrates the spacing as dimension 'L.'. In this embodiment, the spacing or gap 'L' is 3 mm, although a larger or smaller gap still provides benefits. The key consideration is that the spacing L is selected to maximise flow velocity through the suction nozzles 30, 32 given the suction that is applied to the floor tool 8 whilst still allowing debris of a useful range of sizes to enter into the suction chambers 126, 128.

Configuring the leading edge 132 of the suction nozzle so that it is spaced from the floor surface S in this way avoids 'snowploughing' debris in front of the suction nozzle during cleaning that may occur with known floor tools having apertured or 'castellated' leading edges as is often found on existing hard floor tools. Furthermore, by configuring both the front and rear suction nozzles in this way, the same advantage is achieved during forward and reverse strokes of the floor tool, although this is not essential.

Conversely, the trailing edge 130 of the suction nozzles 30, 32 defines a straight linear edge that engages the floor surface in the manner of a lip seal or 'squeegee' to guard against debris accumulating on the cleaning sheet. Beneficially, this avoids the floor surface being marked as well as extending the life of the cleaning sheet.

Each of the adjacent suction chambers 126, 128 is further provided with an additional floor engaging member 136, also in the form of a rubber strip, which defines an interior wall extending longitudinally within the respective suction chamber 126, 128. The interior wall 136 or 'longitudinal strip' divides the interior of the first and second suction chambers 126, 128 into first and second longitudinal suction channels (front and rear suction channels, respectively) 138, 140 which are fluidly linked by apertures or notches 142, 144 formed in the strips 136 thereby defining 'connecting channels'. As can be seen clearly in FIG. 12, each suction nozzle 30, 32 includes two suction outlets 146 that lead into the connecting arms 36, one outlet 146 emerging into the rear of the suction channels 140 in each suction chamber 126, 128.

In use, with the floor tool located on a floor surface, the application of suction to the floor tool 8 by an associated vacuum cleaner generates two different pressure regions within each suction chamber 126, 128 of each suction nozzle 30, 32. Due to the relatively tight seal formed around the rear suction channels 140 by the trailing edge 130 and side edges 134, a relatively high vacuum is established in the rear suction channels 140. This promotes a relatively high-speed air flow which benefits the entrainment of debris located within crevices in the floor surface into the airflow through the rear suction channels 140. Furthermore, since the trailing edge 130 is straight and uniform, this reduces the likelihood of debris passing under the trailing edge which protects the wipe element and the floor pad from debris pickup.

The provision of the connecting channels 142, 144 establishes a relatively low vacuum in the front suction channels 138 to enable dust and relatively large debris located on the floor surface to be entrained within a fluid flow drawn into the front suction channels 138 through the leading edge gap L. This dirt-bearing fluid flow is then conveyed from the front suction channels 138 through the connecting channels 142, 144 to the rear suction channel 140 and then into the connecting arms 36 of the suction nozzle assembly. From there, the airflow continues to the manifold and to the flexible hose.

It should be noted that the apertures 142, 144 defined in the longitudinal strips 136 in the front and rear suction nozzles 30, 32 are not equal in size. More specifically, the apertures 142 in the front suction nozzle 30 are semi-circular in form and have a larger flow area than the apertures 144 in the rear suction nozzle 32 that are rectangular in form. In this particular embodiment, the apertures 142 in the front suction nozzle 30 are semicircles with a radius of 5 mm, the centre of radius being located on the lower edge of the strip 136, therefore resulting in a flow area of approximately 40 $mm^2$, whereas the dimensions of the apertures 144 in the rear suction nozzle 32 are 9 mm by 3 mm resulting in a flow area of approximately 27 $mm^2$ It should be noted that these values are only exemplary.

The lower flow area defined by the apertures 144 in the rear suction nozzle 32 increases the resistance to air flow of the rear suction nozzle 32, which has the effect of increasing the flow through the front suction nozzle 30 in comparison. Therefore, the suction 'power' that is applied to the floor tool is biased towards the front suction nozzle 30 thereby increasing the pickup performance in the front nozzle 30, which is beneficial since it is the front suction nozzle that leads as a user pushes the tool along a floor surface.

By dividing the suction nozzles into two separate chambers 126, 128, with each of the chambers having respective front and rear suction channels 138, 140 it can be assured that a high speed fluid flow through the suction chambers is experienced across the whole width of the floor tool which greatly promotes debris entrainment and pickup. Furthermore, the recessed leading edge 132 reduces snowploughing of debris and thus further improves pickup performance of the floor tool.

Figure 13:
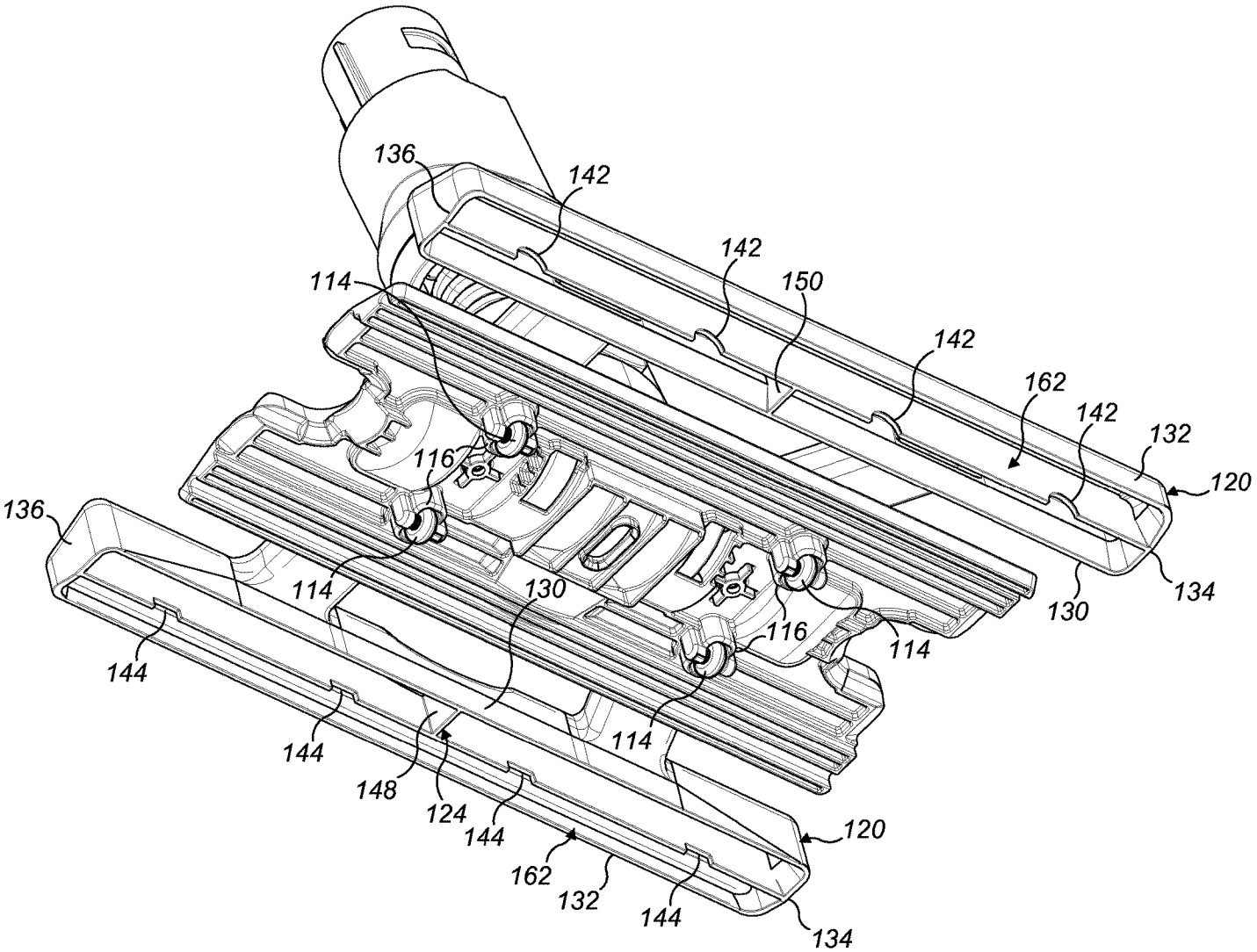
FIG. 13 is a view of a variant of the floor tool in FIG. 10 from underneath.

Further advantages may be realised by removal of a section of the dividing wall 148 of the embodiment in FIG. 12. FIG. 13 illustrates this, and it can be seen that a front section of the dividing wall in FIG. 12 has been removed leaving only a rear section 150 of dividing wall that extending between the longitudinal strips 163 and the trailing edge 130 of the skirts 120. Therefore, a single front suction channel 162 extends across substantially the entire width of the suction nozzles. Removal of the front section of dividing wall eliminates any 'dead space' within the front suction channel where debris could hesitate or become stuck.

Alternatively, the front section of the dividing wall 124 in FIG. 10 need not be removed completely as in the embodiment of FIG. 13. In one embodiment, the front section of the dividing wall 124 may be configured so that is it shallower than the rear section of dividing wall. This leaves a small gap between the lower edge of the front section of the dividing wall and the floor surface which means that air flow can bleed through the gap between the front two chambers 126, 128. This improves debris pickup by guarding against any dead spots in the front chambers 126, 128 but still provides structural support to the longitudinal walls 136.

It is possible for variations to be made to the specific embodiments described above without departing from the scope of the invention defined by the claims. For example, the supporting member has been described above as rectangular, but the skilled person will appreciate that other shapes are also viable; the supporting member could also be triangular, diamond-shaped, or even oval, with appropriately modified suction nozzles.

Also, although the supporting member has been described as being particularly suitable for use with a non poly-based non-woven cleaning sheet, it should be appreciated that this is not essential to the invention and it may also be used with other types of wiping members such as woven cleaning cloths. Still alternatively, the supporting member may carry a porous cleaning member such as a sponge pad that is secured on its underside, by a hook-and-loop type fastening system for example, or formed integrally with it.

Although the floor tool may in principle be made from a wide range of materials, plastics are currently preferred for their cost effectiveness and ease of manufacture since parts can be formed, for example by injection moulding, into almost any desired shape. In the context of the floor tool of the invention, the choice of plastics influences the effectiveness and the long term durability of the floor tool since it is designed to be used with wipes that contain a variety of chemicals which may have a detrimental impact on some plastics.

Preferably, the first and second neck portions are made from injection moulded PC-PBT since this material is strong yet resistant to chemical attack. The neck connector is preferably talc-filled polypropylene (PP) since this provides increased strength to this part so as to withstand the forces applied to it via the wand, but is more cost effective that PC-PBT.

The suction nozzle assembly is predominantly formed from polypropylene, apart from the skirt which is thermoplastic elastomer (TPE) which is preferably overmoulded onto a respective spine of a suction nozzle.

Turning to the support member, it is currently envisaged that the carrier is injection moulded talc-filled polypropylene for increased strength, and the floor pad is a combination of polypropylene for the upper surface to provide strength and thermoplastic elastomer plus a blowing agent as the body of the floor pad to provide it with a degree of resilience which improves the contact with the floor surface.

The invention claimed is:

1. A floor tool for a vacuum cleaning appliance comprising a body including a suction nozzle, a neck coupled to the body so as to pivot relative to the body about an axis 'A', wherein the neck includes a base portion that defines a rail formation located at least partially about its circumference and the body includes a runner formation that is engaged with the rail formation, the rail formation being slidable relative to the runner formation thereby coupling the base portion to the body but permitting the base portion to pivot relative to the body, wherein the engagement between the runner formation and the rail formation extends at least partially between the body and an air flow conduit that passes through the base portion in a direction in which axis 'A' extends, wherein the rail formation of the base portion includes a rim, and wherein the runner formation on the body includes a projection that overlaps extends in the direction in which axis 'A' extends, the rim, and is slidable relative to the rim.

2. The floor tool of claim 1, wherein the base portion includes a flange that extends radially inwardly from the rim about a portion thereof, wherein end points of the flange define limit stops that are engageable with the runner formation to limit the angular movement of the base portion.

3. The floor tool of claim 1, where the conduit is fluidly linked between the suction nozzle and the neck.

4. The floor tool of claim 1, wherein the base portion has an internal diameter that is greater than the external dimension of the conduit in the region of the base portion, thereby permitting the conduit to move linearly with respect to the base portion in a direction perpendicular to the pivot axis 'A'.

5. The floor tool of claim 4, wherein the conduit includes one or more guide members that cooperate with sockets in the body to guide movement of the conduit relative to the base portion of the neck.

6. The floor tool of claim 1, wherein a second neck section is connected to the base portion so as to be pivotable about the base portion about a second axis 'B' that is substantially perpendicular to the first axis 'A'.

7. The floor tool of claim 6, wherein the second neck section is connected to the conduit and includes a connector for connecting to an associated pipe of a vacuum cleaner.

8. The floor tool of claim 1, wherein the body includes a support member configured to support a cleaning sheet, and wherein the suction nozzle extends along an edge of the support member.

9. The floor tool of claim 8, further including a second suction nozzle that extends along a further edge of the support member.

10. The floor tool of claim 9, wherein the section suction nozzle is parallel to the first suction nozzle.

11. The floor tool of claim 9, wherein the first and second suction nozzles are fluidly connected to a manifold that forms part of the conduit.

12. The floor tool of claim 11, wherein the manifold is positioned centrally on the body and extends in a direction parallel to the suction nozzle.

13. A vacuum cleaner comprising a floor tool comprising a body including a suction nozzle, a neck coupled to the body so as to pivot relative to the body about an axis 'A', wherein the neck includes a base portion that defines a rail formation located at least partially about its circumference and the body includes a runner formation that is engaged with the rail formation, the rail formation being slidable relative to the runner formation thereby coupling the base portion to the body but permitting the base portion to pivot relative to the body, wherein the engagement between the runner formation and the rail formation extends at least partially between the body and an air flow conduit that passes through the base portion in a direction in which axis 'A' extends, wherein the rail formation of the base portion includes a rim, and wherein the runner formation on the body includes a projection that overlaps extends in the direction in which axis 'A' extends, the rim, and is slidable relative to the rim.

14. A floor tool for a vacuum cleaning appliance comprising a body including a suction nozzle, a neck coupled to the body so as to pivot relative to the body about an axis 'A', wherein the neck includes a base portion that defines a rail formation located at least partially about its circumference and the body includes a runner formation that is engaged with the rail formation, the rail formation being slidable relative to the runner formation thereby coupling the base portion to the body but permitting the base portion to pivot relative to the body, wherein the body includes an air flow conduit fluidly linked between the suction nozzle and the neck and passing through an opening of the base portion in a direction in which axis 'A' extends, and wherein the opening of the base portion has an internal diameter that is greater than an external dimension of the conduit in the region of the base portion so that the conduit is permitted to move linearly with respect to the base portion in a direction perpendicular to the pivot axis 'A'.

* * * * *